United States Patent [19]

Wilken et al.

[11] Patent Number: 5,052,592

[45] Date of Patent: Oct. 1, 1991

[54] DISPENSER FOR PASTE COMPOSITIONS

[75] Inventors: Josef Wilken; Winfried Degenhard; Ludger Hackmann, all of Lohne/Oldenburg, Fed. Rep. of Germany

[73] Assignee: Bramlage Gesellschaft mit beschränkter Haftung, Lohne/Oldenburg, Fed. Rep. of Germany

[21] Appl. No.: 393,484

[22] Filed: Aug. 14, 1989

[51] Int. Cl.[5] ..... B65D 37/00

[52] U.S. Cl. ..... 222/212; 222/387; 222/391; 222/514

[58] Field of Search ..... 222/207, 209, 212, 252, 222/260, 319, 378, 380, 383, 385, 386, 387, 405, 563, 514, 391, 256–257

[56] References Cited

U.S. PATENT DOCUMENTS

| | | | |
|---|---|---|---|
| 4,347,953 | 9/1982 | Bauer | 222/383 X |
| 4,690,304 | 9/1987 | Morel | 222/545 |
| 4,809,887 | 3/1989 | Jupin et al. | 222/207 |
| 4,913,322 | 4/1990 | Stöffer et al. | 222/207 |
| 4,936,493 | 6/1990 | Foster et al. | 222/209 |
| 4,946,076 | 8/1990 | Hackman et al. | 222/207 |
| 4,949,876 | 8/1990 | Schneider | 222/209 |
| 4,962,870 | 10/1990 | Schneider | 222/207 |

FOREIGN PATENT DOCUMENTS

| | | |
|---|---|---|
| 0222605 | 7/1986 | European Pat. Off. . |
| 0160785 | 2/1985 | Fed. Rep. of Germany . |
| 3416999 | 11/1985 | Fed. Rep. of Germany . |
| 2229625 | 12/1974 | France . |

*Primary Examiner*—Michael S. Huppert
*Assistant Examiner*—Kenneth DeRosa
*Attorney, Agent, or Firm*—Martin A. Farber

[57] ABSTRACT

A dispenser for pasty compositions having a housing which contains a piston which can be displaced only in the emptying direction, the housing having an external handle to actuate a pump wall, which wall can be pushed in the direction of the piston in order to dispense the contents from an outlet opening in a top cover of the housing, the cover being connected to the pump wall by a small tube, and the pump wall having a tube channel formed thereon. A plug is formed on the tube channel at its end, the plug extending into a cover-side outlet opening and closing the outlet opening form below.

23 Claims, 7 Drawing Sheets

DISPENSER FOR PASTE COMPOSITIONS

FIELD AND BACKGROUND OF THE INVENTION

The present invention relates to a dispenser for pasty compositions having a housing which contains a piston which can be displaced only in the emptying direction, the housing having an external handle for actuating a pump wall which wall can be pushed in the direction of the piston in order to dispense the contents of the dispenser from an outlet opening in a top cover of the housing, the cover being connected to the pump wall by a small tube.

A dispenser of this type is known from the Applicant's Federal Republic of Germany No. OS 34 16 999. In that publication the cover forms the actuating handle and, at the same time, the application surface which spreads the pasty composition for which purpose the cover is cupola-shaped. As a result of the pressure of the application the piston in each case lifts above the filling material column. This pulling up of the piston takes place with priority, i.e. before the remaining amount in the tube, which exerts a blocking action in the manner of a plug, could counteract the vacuum which is being created in the dispenser head. The pasty composition itself therefore, acts as and forms a valve.

Upon dispensing without utilization of the body-side contact pressure and therefore, for instance upon a depressing of the cover of the dispenser by hand, the hand of the operator may come into contact with the pasty composition. On the other hand, the outlet opening is in most cases rather small, so that the user may accidentally place his finger over it. The pressure which is then applied may lead to a spurting of the outward swelling contents of the dispenser, which, as a rule, results in a loss.

SUMMARY OF THE INVENTION

It is therefore the object of the invention so to develop a dispenser of this type, in a manner which is easy to manufacture and advantageous in use, that the hand of the operator no longer comes into contact with the material dispensed upon actuation.

According to the invention a plug (17) is formed on the tube channel at its end, said plug extending into the cover-side outlet opening (16) and closing said outlet opening from below.

As a result of the development of the invention, a dispenser of the type described which is of increased utility is created: The unpleasant smearing of the actuating hand and thus also of the actuating region of the dispenser no longer occurs. Acceptance is increased. The structural means are simple and suitable. In this manner according to another feature of the invention the actuating handle and is developed as a button is arranged between pump wall and cover which can be displaced transverse to the top of the cover, and the displacement of which is translated, deflected by 90 , into a downward movement of the tube and thus of the wall. The mechanism for this is arranged in a longitudinal section which is in any event required for the valve function of the tube. This section is therefore utilized in the most favorable manner. The other feature that the movement of displacement of the button is deflected by means of an angle lever which is mounted fixed in position acts in corresponding space-saving manner. Furthermore, extremely favorable leverage can be applied in this case with extremely short strokes.

A development, which is favorable from the standpoint of manufacture, is obtained by unity of material between the button and angle lever and by the formation of a film hinge between the two. A sufficiently tough and flexible plastic material is accordingly employed.

It furthermore is advantageous for the upper mouth-edge of the tube to be lifted upon actuation off from the bottom of the cover and for the outlet opening of the cover to be laterally staggered with respect to the mouth of the tube, the upper end section of the tube being developed as piston which travels in sealing fashion within a cylinder which is formed by a collar on the bottom of the cover. In addition to advantages with respect to stabilization—the collar has a stiffening effect on the cover—the result is also thereby obtained, with respect to the hydraulic system, that, upon the pressing out by means of the pump wall, a continuously enlarging prechamber is formed in front of the mouth of the tube. On the one hand, the material lying above the tube end is squeezed out without residue upon the return of the piston, which is developed as a tube. On the other hand, the covering quantity initially contributes to preventing the drawing in of secondary air. By the use of the above-mentioned features, a simple but effective sealing closure device is created by a development such that the tube extends into the outlet opening with an upper plug. In view of the laterally staggered path of the material, there is furthermore even created a second sealing point due to the fact that the bottom side of the cover has a projection which enters in closing manner into the mouth of the tube.

It has furthermore proved favorable for the cover to be formed by the bottom of a cup, the wall of the cup having an opening for the button and bearing the pivot pin for the angle lever. The pivot pin can consist of stub shafts formed directly on the angle lever and which can be attached by a corresponding oblique cut in the end surfaces in the manner of a clip attachment, or else of a separate shaft. A favorable, non-loseable attachment of the cup is achieved by its wall being clipped over an annular rib on the housing.

An attachment of the button which avoids an exposed position and thus an accidental, undesired dispensing of the filling material is that the button is located in a circular segment-shaped cutout in the cup wall. It is advantageous in this case for the outer surface of the button to follow the contour of the cup wall. According to another feature of the invention one arm of the angle lever grasps the tube in the manner of a fork and has spherical pressure skids on its bottom side. Due to the fork shape, the actuating handle can thus be placed laterally on the tube and thus before the bottom which forms the cover is connected to the housing. The spherical shape of the pressure skids promotes easy movement upon the actuation and takes into account the top structure, which is displaced in the plane of swing.

Also with a view toward ease of actuation, one advantageous solution consists of anti-twist means between cup wall and housing. Lateral stresses can thus effectively be kept away from the actuating handle. Such anti-twist means, for instance, can consist concretely of tongue-and-groove engagement, which means would have to be axially aligned.

A structurally simplified closure device furthermore results from the fact that a plug which extends into the cover-side outlet opening is arranged in the cover-side mouth of the tube channel, the plug being connected to the tube by radial webs which leave annular slot sections. A plug body which is thus freely "suspended" in the dispensing path has a high sealing effect since its arrangement which is displaceable within limits; it can automatically adapt itself in optimal manner to variations in tolerance. It is, so to speak, flowed around by the material to be dispensed. In order to create good conditions here from the standpoint of flow technology and not to create any problems, on the other hand, with respect to the shape, the plug body is imparted the shape of a truncated double cone from the base of which the radial webs extend. In the closed position of the dispenser, one truncated cone engages into the corresponding outlet opening, while the other acts as distribution cone, so that an equal feeding of the material to be dispensed takes place with respect to the annular slot sections. It is advantageous in this connection to provide three radial webs which are arranged at an equal angle apart. In order to arrive at a rotationally symmetrical structure of the dispenser body in this region, according to another feature of the longitudinal axis of the plug body coincide with the central longitudinal axis of the dispenser. With a view toward a precisely-measured maximum dispensed amount, an advantageous development is obtained by a limit stop of the button. After a full stroke, the button strikes against corresponding limit stop means on the housing side. This means is advantageously formed by the end surfaces of two bearing lugs of the dispenser which bear the button shaft, their end surfaces pointing in the direction of the button. The bearing lugs thus have an additional function.

SUMMARY OF THE INVENTION

The invention will be explained in greater detail below by way of example with reference to an embodiment shown in the drawings, in which FIG. 1 shows the dispenser of the invention, with the protective cap covering the dispenser head, FIG. 2 is a section along the line II—II of FIG. 2, showing the basic position, FIG. 3 is a section corresponding to FIG. 2, in the actuating phase, FIG. 4 is a section along the line IV—IV of FIG. 2, FIG. 5 is a top view of the dispenser with the protective cap removed, FIG. 6 is a view of the head of the dispenser with the button cut away and a free view into the inside of the dispenser head, FIG. 7 is a detailed showing of the cup forming the cover, FIG. 8 is a bottom view thereof, FIG. 9 is a section corresponding to FIG. 2 through a modified embodiment of the dispenser of the invention, FIG. 10 is a further enlarged top view of the tube, FIG. 11 is a cross section through an alternative embodiment of the dispenser, FIG. 12 is an enlarged top view of the tube channel of the object of FIG. 11, and FIG. 13 is a further alternative embodiment of the dispenser.

DETAILED DESCRIPTION OF THE PREFERRED EMBODIMENTS

Figure 1:
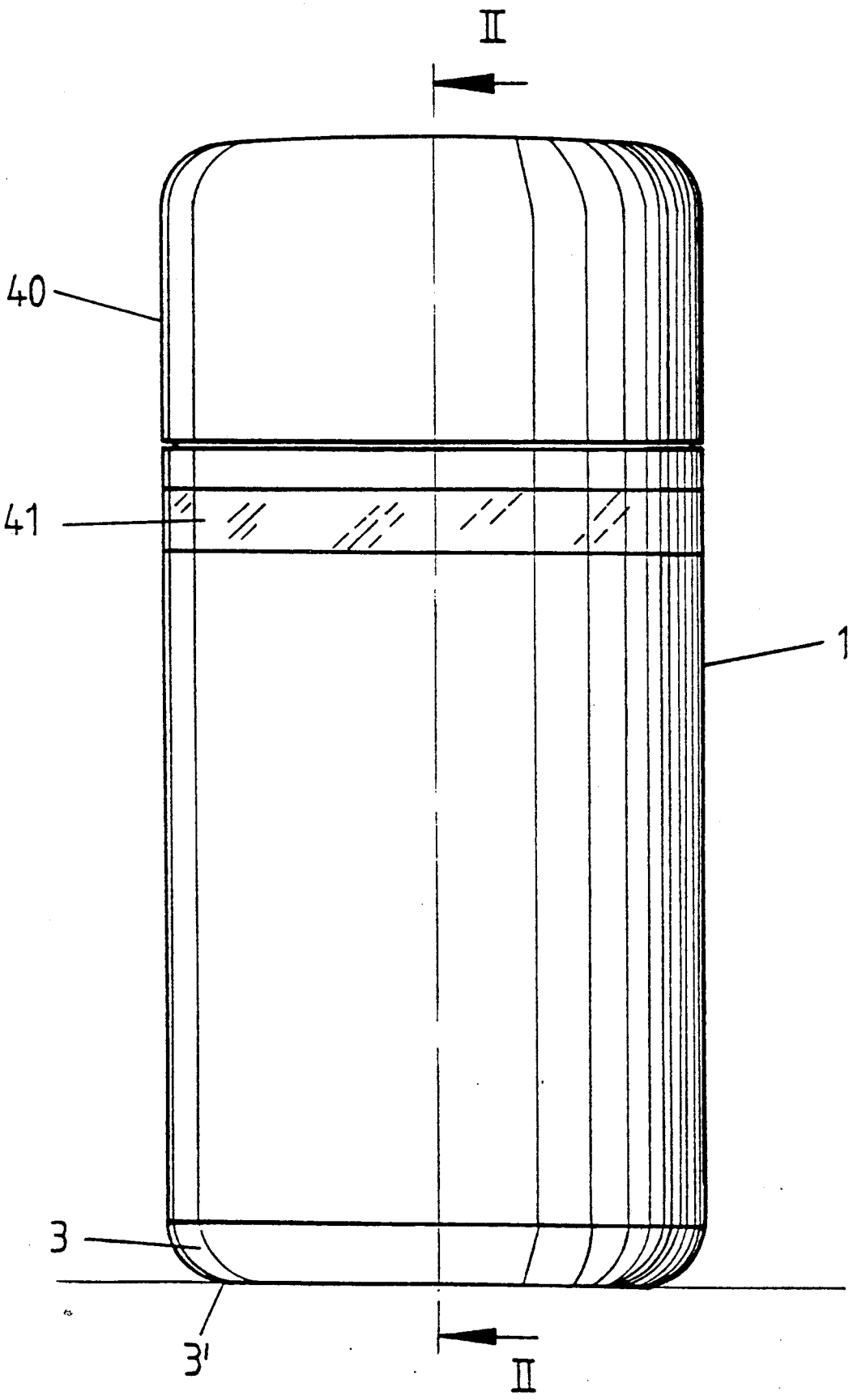

The cylindrically shaped housing 1 of the dispenser contains a piston 2. Its oppositely directed edge lips 2' are guided on the cylindrical inner wall 1' of the housing.

The housing 1 is closed on the bottom by a bottom part 3 forming a stand 3'. An inner collar 3'' is formed on the bottom part 3, the inner collar extending with its end surface so far into the housing 1 that it extends to just in front of the piston 2. Furthermore, the bottom part 3 has a central opening 4 for air equalization upon the upward displacement of the piston.

The housing 1 is filled with the dispenser head facing downward. In order to make it possible for the air trapped between the piston 2 and filling material to escape, the initial region of the inner wall 1' of the housing is provided with longitudinal grooves at 1''.

The piston 2 can be displaced only in the emptying direction (arrow x). For this purpose it is provided on its broad surface facing the base-side end of the housing with a so-called clamping module 5 in the form of a star of spring steel having radially directed prongs 5'. When flattened, the diameter thereof, which is defined by the ends of the prongs, is larger than the inside diameter of the housing 1, as a result of which the prong ends 5' as oblique feet lock in blocking manner on the inner wall 1' of the housing in the direction opposite the direction of the arrow x.

At the end which is opposite the bottom part 3, the housing 1 bears a resiliently restoring bellows-like pump wall 6 which can be pressed in the direction of the piston 2 for the dispensing of the pasty composition. The pump wall is slightly curved upward and passes peripherally into a clamping ring 7. This clamping ring, which is of S-shaped cross section, engages from below into an annular groove 8 in the housing 1. In order to prevent twisting, the annular groove 8 is provided with longitudinal ribs which embed themselves into the elastic material of the clamped clamping-ring arm.

The wall of the central region 6' of the pump wall 6 is clearly thicker than the concentrically adjoining highly flexible annular region, which then continues into the clamping ring 7 which is again thicker.

The central pump-wall region 6' forms an upwardly directed small tube 9. The latter has a cylindrical surrounding wall. The upper end section of the tube is developed as piston 10. The piston is guided in axially displaceable manner in a cylinder 11. For sealed guidance, the piston 10 bears annular ribs 12 formed on the outer wall. Two such annular ribs 12 are provided. For the self-centering centering introduction of the piston 10 upon assembly, the inner edge of the cylinder is beveled. Beveling of the annular ribs 12 in the same direction also serves to facilitate introduction.

The cylinder 11 is formed on a cover 13 extending over the top opening Ö of the housing 1. The cover 13 extends at an axial distance y above the pump wall 6. The space created in this manner is designated R. The axial distance y corresponds approximately to half the diameter of the housing 1. The cover 13 is a part or, more precisely, the bottom of a cup 14 clipped on the upper edge of the housing. The cover 13 is furthermore drawn in with a slight curvature. It forms a stripping trough 15 at its center. An outlet opening 16 for the pasty composition is provided in said stripping trough. The diameter of the stripping trough 15 corresponds essentially to that of the collar which is formed on the bottom side of the cover 13 and surrounds the cylinder 11. The collar terminates at the mid-height of the space R between cover 13 and pump wall 6.

In the basic position (FIG. 2) of the dispenser, the front end of the piston 10 rests, due to the restoring force of the pump wall 6, under a spring load against the corresponding horizontal inner surface of the cylinder 11, i.e. the cover 13. In this position a plug 17 formed on the tube 9 extends into the eccentrically located outlet opening 16. The plug is of conical shape and tapered on the outlet-opening side. The passage opening 16 also has a corresponding shape of flank. In its basic position the top of the plug 17 is flush with the bottom of the stripping trough 15. In addition to this seal, a second seal is also provided. It is formed by a semi-spherical projection 18 which is also located eccentrically. The projection extends from the cover 13 and enters in closing manner into the mouth 19' of the tube 9 or, more precisely stated, into an axially-directed tube channel 19 the other mouth 19'' of which is open toward the storage chamber space for the pasty composition.

The opening up of the dispensing path is effected by means of an actuating handle provided in the dispenser head. A button T arranged in the space R between pump wall 6 and cover 13 is part of said actuating handle. The button T is displacable transversely to the longitudinal central axis z-z of the dispenser and therefore transversely to the top of the cover. Its horizontal movement of displacement is deflected by 90° into a downward movement, along the central longitudinal axis z-z, of the tube 9 and thus of the pump wall 6. The actuation position can be noted from FIG. 3. As can be noted there, the button T extends integrally into a horizontally mounted angle lever 20. The angle lever forms a right angle with arms of different length. The mounting of the lever is effected at the vertex of the angle arms. Its mounting shaft (i.e., an axle or pin) has the reference number 21. It can consist of stub shafts formed (pins) thereon which protrude beyond the width of the angle arms and are clipped into the openings of stationary bearing lugs 22. In the embodiment shown however the shaft 21 is developed separately (see FIG. 4). Its bearing lugs 22 extend from the open-side edge of the housing 1. The niche-like indentations 23 of the otherwise circular housing edge also can be noted from FIG. 4. The bearing lugs 22 connect there with right-angle sections which extend back into the wall region. The bottom of the niche is closed. The receiving shaft (i.e., a shaftway), between the two parallel bearing lugs 22 is designated 25. Its walls are relatively flexible so that they can move resiliently outwardly upon the attachment of the shaft 21. A centering or run-on bevel 26 is arranged in front of the shaft recesses.

Button T and angle arm 20' consist of a single molded piece, i.e. they are made from the same material. To translate the linear movement of the button T into the swinging movement of the angle lever 20, a hinge place in the form of a film hinge 27 is provided. The central web 28 of the button T has a wall thickness which is several times greater than it; the arms 20' and 20'' of the angle lever 20 are also made thicker than the said hinge place. For free movement of the angle arm 20 upon the displacement, a wedge-shaped cutout 29 extends from the bottom of the button web.

In order to receive the button T, the cup 14 has a window-shaped opening 30 which has a circular shape in the same way as the actuating surface of the button body. The opening (30) is provided in a thickened region of the cup wall 14' so that an enlarged guidance length results there for the displacement movement. The button T is furthermore located in a circular segment-shaped notch 31 of the cup wall 14'. However, the notch does not extend over the entire height of the cup wall; it terminates at a distance from the lower edge of the cup. In this way, a kind of windowsill 32 is produced. The surface of this windowsill is tangent to the opening 30. In upward direction the cup 14 passes into a definite transverse rounding.

The outer surface of the button T is convexly curved. Seen in top view, the contour of the curvature corresponds essentially to that of the cup wall 14'.

In order to keep the button T free of transverse stresses, an anti-twist means has been provided between cup wall 14' housing 1. On the housing side the anti-twist means consists of an axially-directed rib 33. The latter engages with form-fit into a longitudinal groove 34 which is open on top or into a correspondingly shaped depression in the housing. As can be noted from FIG. 4, two such anti-twist means are provided diametrically opposite each other. Similar relief results also from the particular development of the angle lever 20 or, more precisely, of its longer arm 20'' which points in the direction of the tube. This arm 20'' grasps the cylindrical tube 9 in the manner of a fork. The corresponding fork grip namely also prevents canting of the angle lever. The arms of the fork bear the reference number 35. On their bottom side, the latter form pressure skids 36 which are rounded in the plane of swing. The pressure skids slide, with shifting point of contact, on the stiffened annular zone of the pump wall 6 (see FIG. 3).

Figure 2:
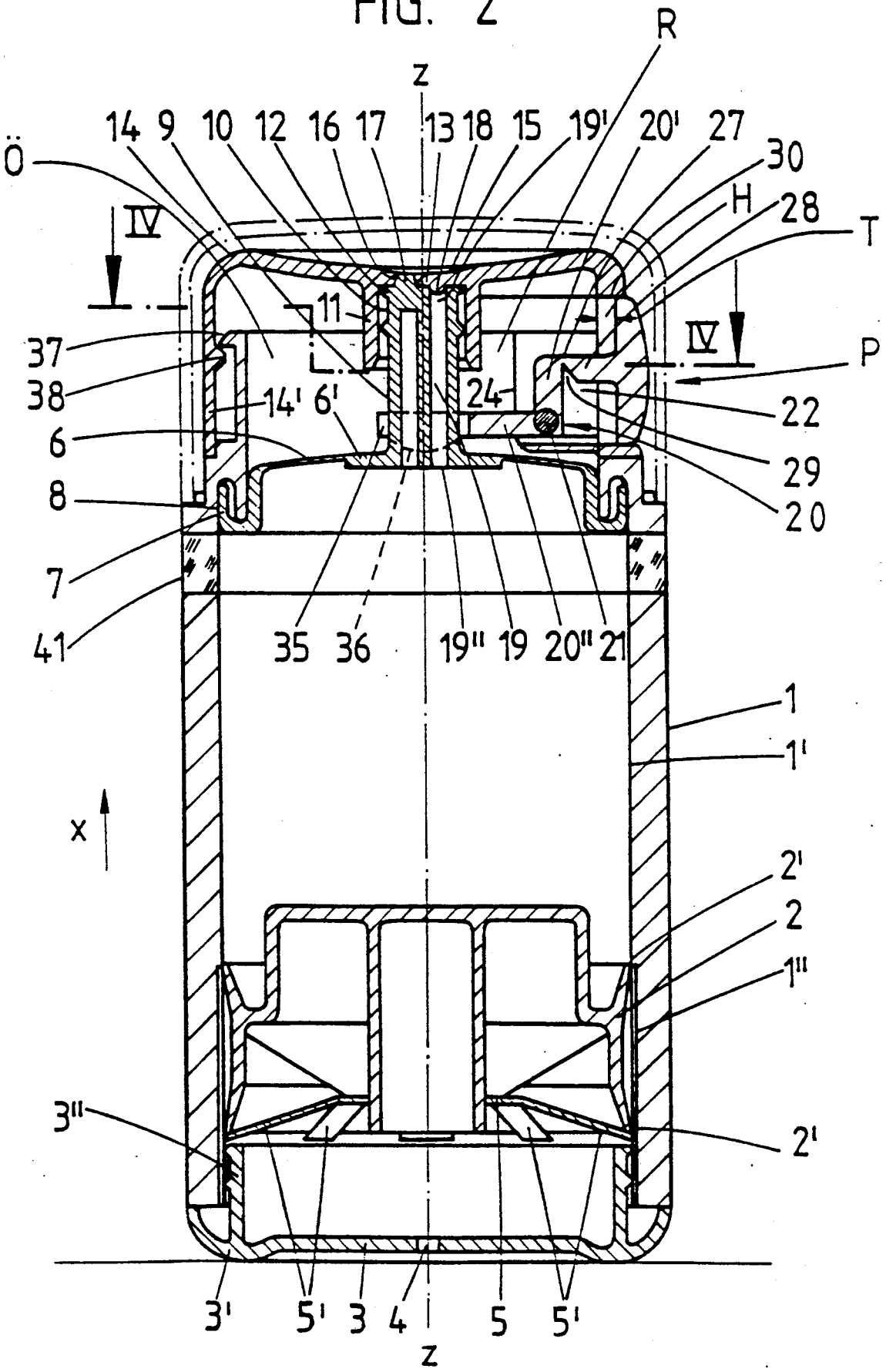
Figure 3:
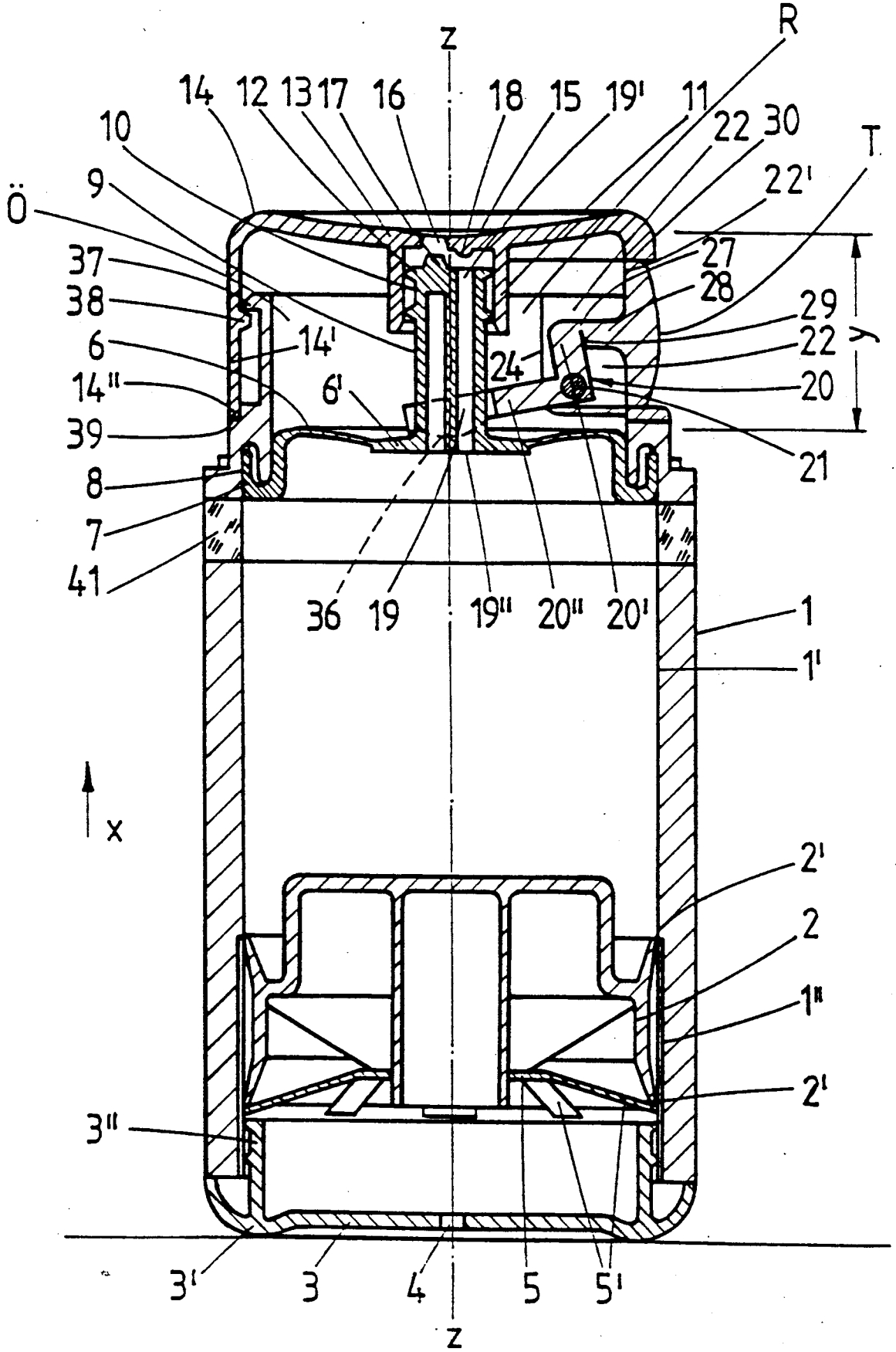
Figure 4:
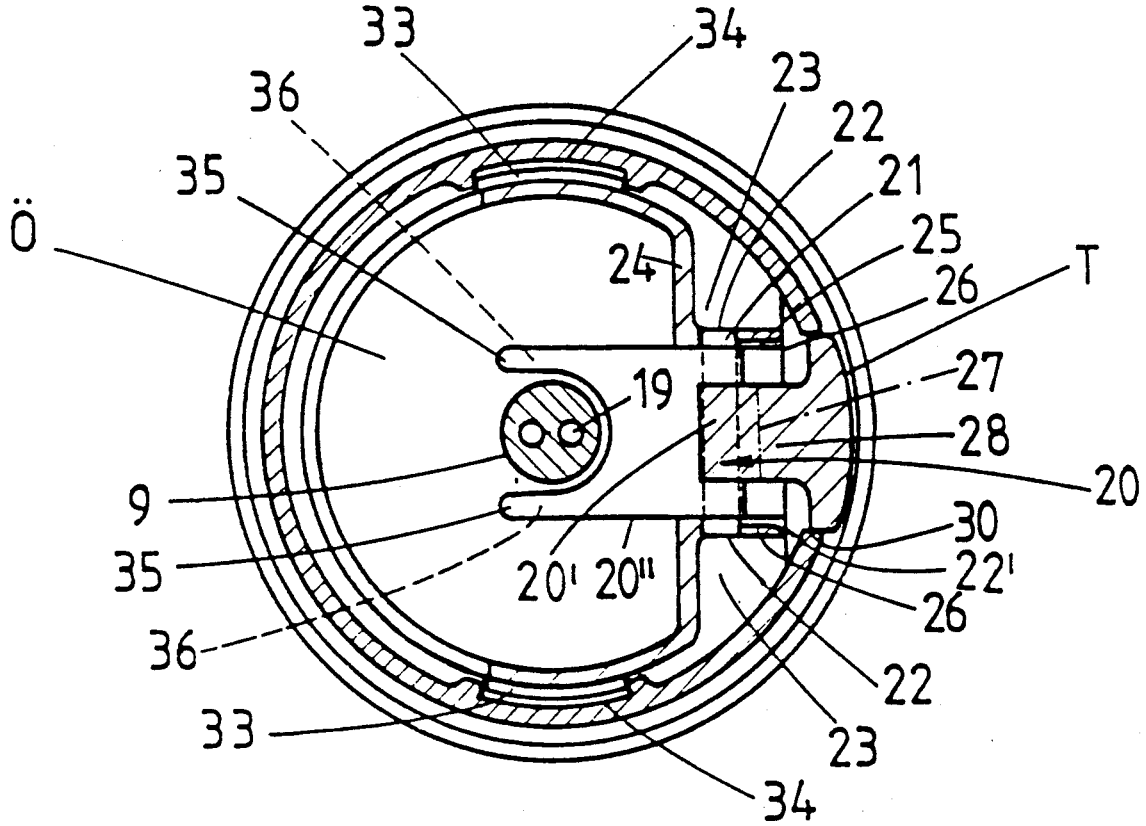
Figure 5:
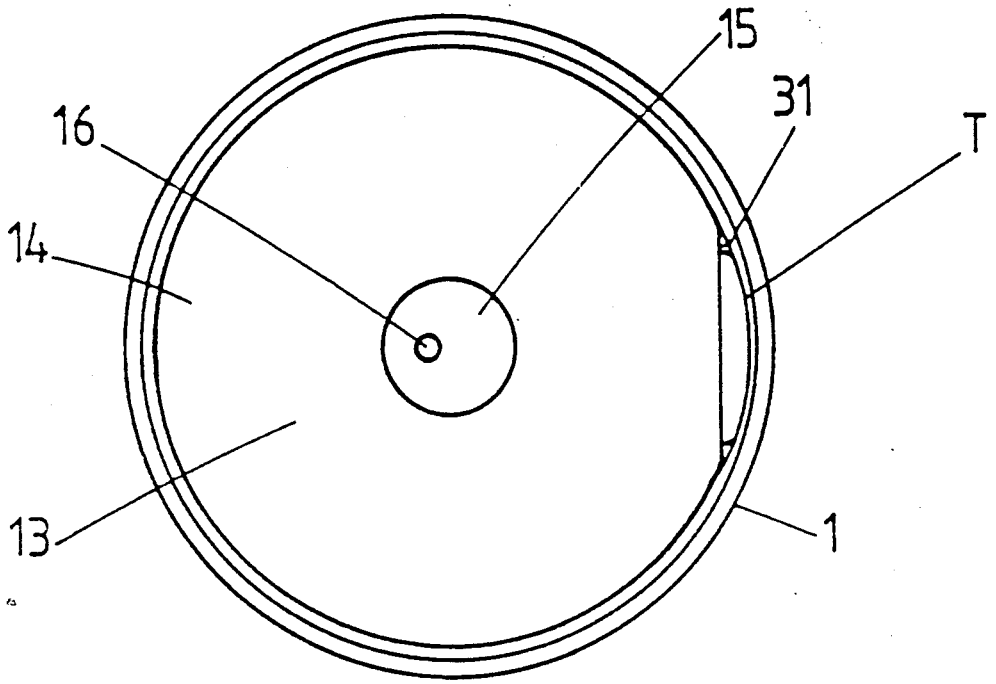
Figure 6:
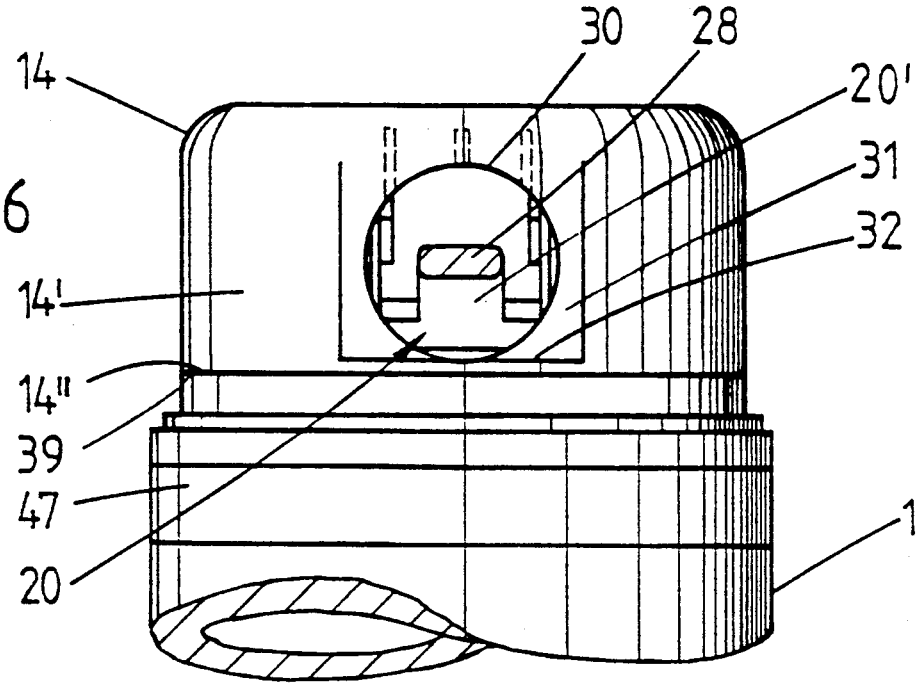
Figure 7:
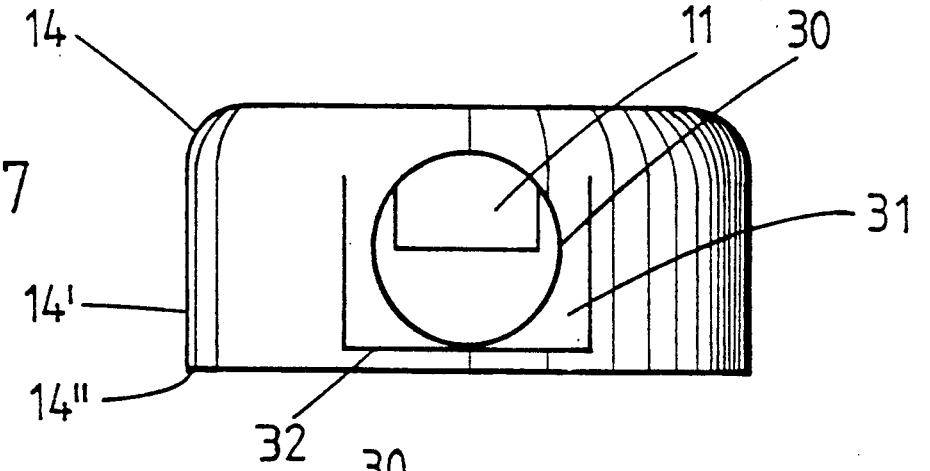
Figure 8:
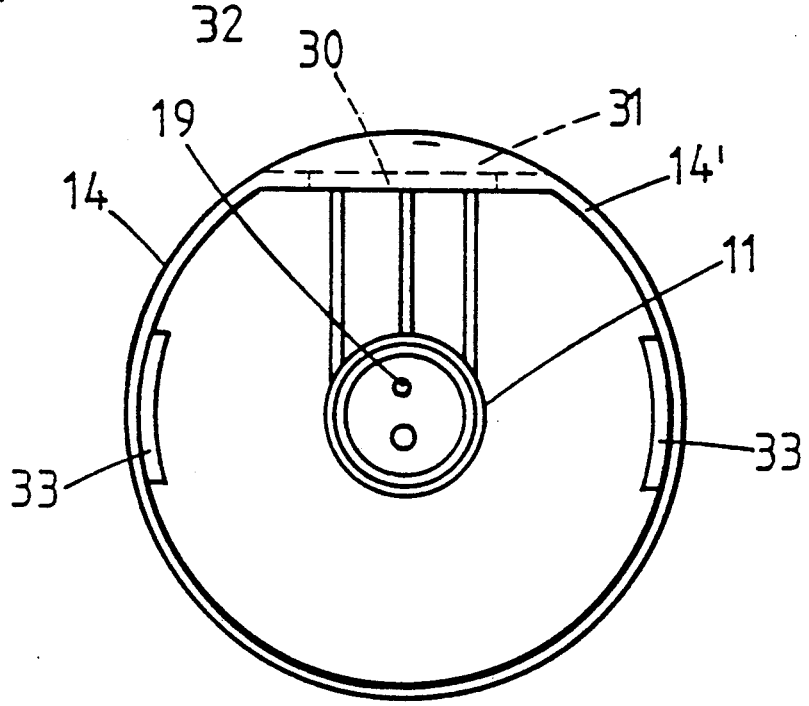

The place of clipping between the cup 14 or its cup wall 14' and the end section of the housing 1 which is tapered in neck-like manner can be noted from FIGS. 2 and 3. In this case the neck has an outwardly directed annular rib 37 which is gripped by a detent projection 38 on the inside of cup wall 14. The two functional parts form oblique flanks which facilitate the clip attachment. The cup edge 14'' rests on an annular shoulder 39 of the housing 1. These means can be identical with the anti-twist means 33/34.

The dispenser head bears a protective cap 40 covering it. The protective cap is held in position by a force-fit.

A circumferential viewing window 41 in the region of the neck of the housing 1 serves as "empty" indicator. The piston which finally moves into this window can, for instance, be red.

The dispenser described operates, briefly, as follows: Upon removal of the protective cap 40, pressure is exerted on the button T in the direction of the arrow P. The force introduced is converted into a linear stroke and deflected into a downwardly directed actuating swinging stroke, the fork arms 35 displacing the cup wall 6 axially in the direction of the piston 2. This takes place against the restoring force of the pump wall. The piston 2 rests on the clamping module 3 so that it cannot move downward. The pasty composition therefore is forced out into the stripping trough 15 through the tube channel 19 of the tube, leaving the cylinder chamber via the outlet opening 16. As soon as the button T is released again, a vacuum is produced inside the housing. The flexible pump wall 6, which returns into its basic position, consequently pulls the piston 2 up in the direction of the arrow x over the filling material column. The corresponding restoration has already been completed before the quantity remaining in the tube or tube channel 19 could reach the inner mouth end 19'' thus serving as a as "plug". The quantity above the tube 9 and located in the cylinder space also favors this effect. On the other hand, this quantity is also forced out proportionally by the restoration of the pump wall into its basic position.

Figure 9:
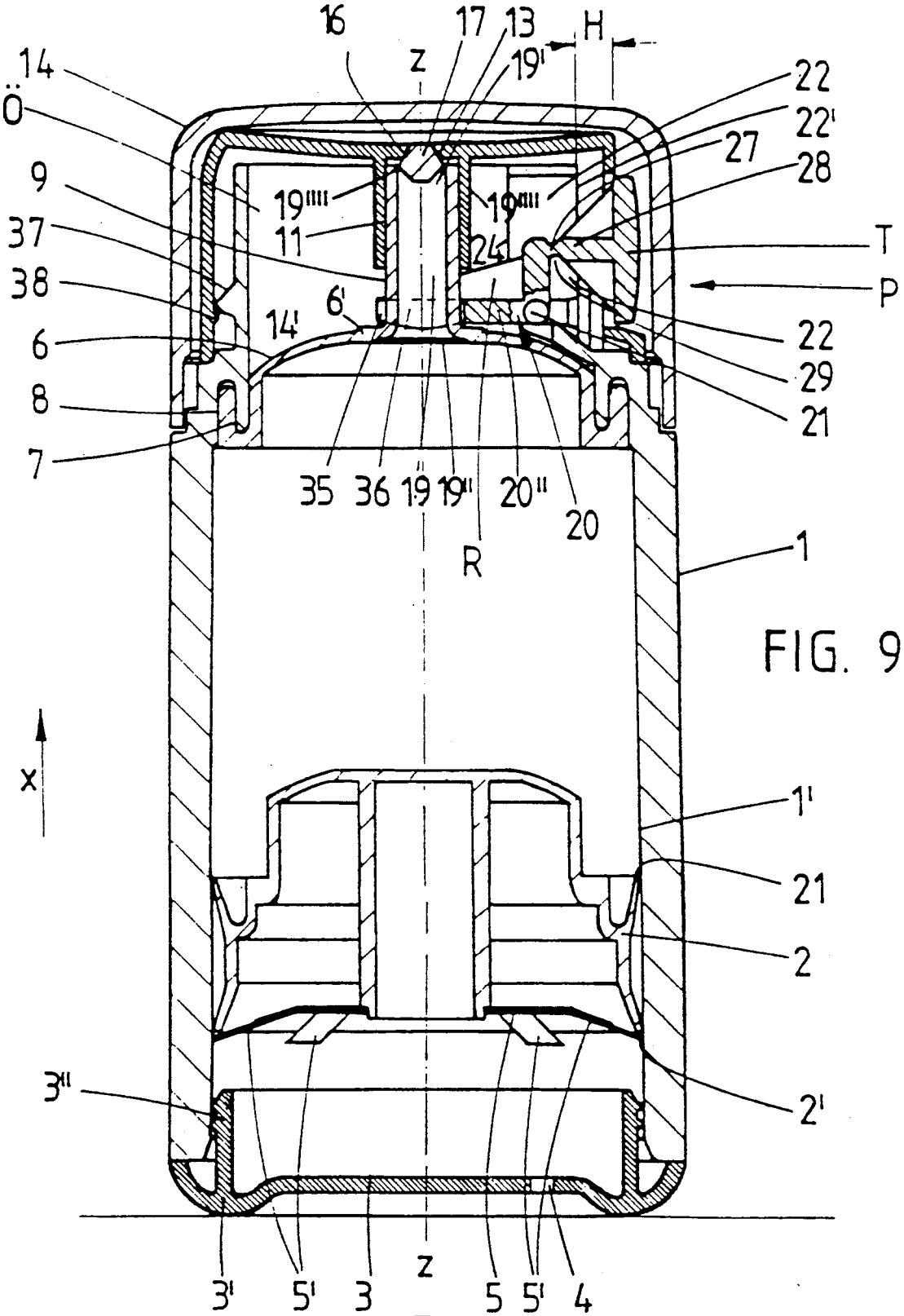
Figure 10:
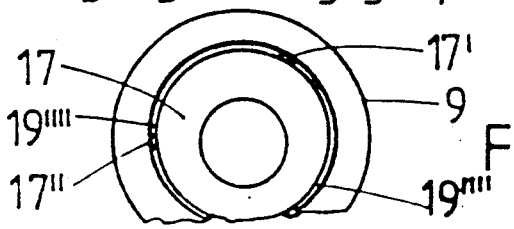

The variant in accordance with FIGS. 9 and 10 is, in principle, of the same construction, the reference numbers having therefore been employed accordingly, in part without repeating their description. The difference from the previous embodiment consists in this case in the fact that in the cover-side mouth 19' of the tube channel 19, the plug 17 and the tube channel are arranged centrally. The plug 17 which extends into the cover-side outlet opening 16 which is provided also in this embodiment, is connected to the inner wall of the tube by radial webs (17'). Seen in circumferential direction, the radial webs leave annular slot sections 19'''' free between themselves (FIG. 10). Passing through said slot sections, the material to be dispensed flows around the body of the plug and collects in the prechamber of the cylinder 11. From there it centrally leaves the outlet opening 16 of the cup 14.

As can be seen, the plug body has the shape of a truncated double cone. Its truncated cone which protrudes above the upper edge of the tube 9 forms the actual closure plug 17. Its oppositely directed truncated cone which extends practically entirely into the tube and therefore into the tube channel 19, acts as flow divider. The rotationally symmetrical construction leads to equal distribution conditions with respect to the individual annular slot sections 19'''' between the radial webs 17'. The latter extend from that section of the plug body which has the largest cross section, namely from the obtuse-angled edge of the back-to-back base of the truncated double cone. The webs are essentially aligned with the end surface of the tube 9.

The radial webs 17' are arranged equal angles apart. A triple partition is preferably employed.

In the basic position, the bottom (cover 13) of the cup 14 extends in the cylinder region at a slight distance from the corresponding end surface of the tube 9. In this way, a certain restoring force of the plug body can be utilized, which thus engages with initial stress into the central entrance opening 16 which forms an annular flank corresponding to the angle of the truncated cone. As can be noted, the longitudinal axis of the plug body and the central longitudinal axis z-z of the dispenser coincide.

In order to obtain an actuating stroke H of the button T which guarantees a constant dosaging, both dispenser types (FIGS. 1–8; 9–10) have a limit stop for the button T. The limit stop on the housing side is in this case formed in simple manner by the end surfaces 22' of the two above-described bearing lugs 22, the end surfaces pointing toward the button and the bearing lugs forming the receiving shaft 25 for the button T and the bearing recesses for the button shaft (pin (S)21.

The film hinge 27 differs in its development from the film hinge 27 described above in the manner that the notches which reduce the web width now extend not only from the bottom but also from both sides of the arm 20' of the button T. Furthermore, the plate forming the button is stiffened by the attachment of struts on its top and bottom side, the struts stiffening the plate with the arm 20'. The struts extend outside the region of the bearing-lug end surfaces 22'.

Figure 11:
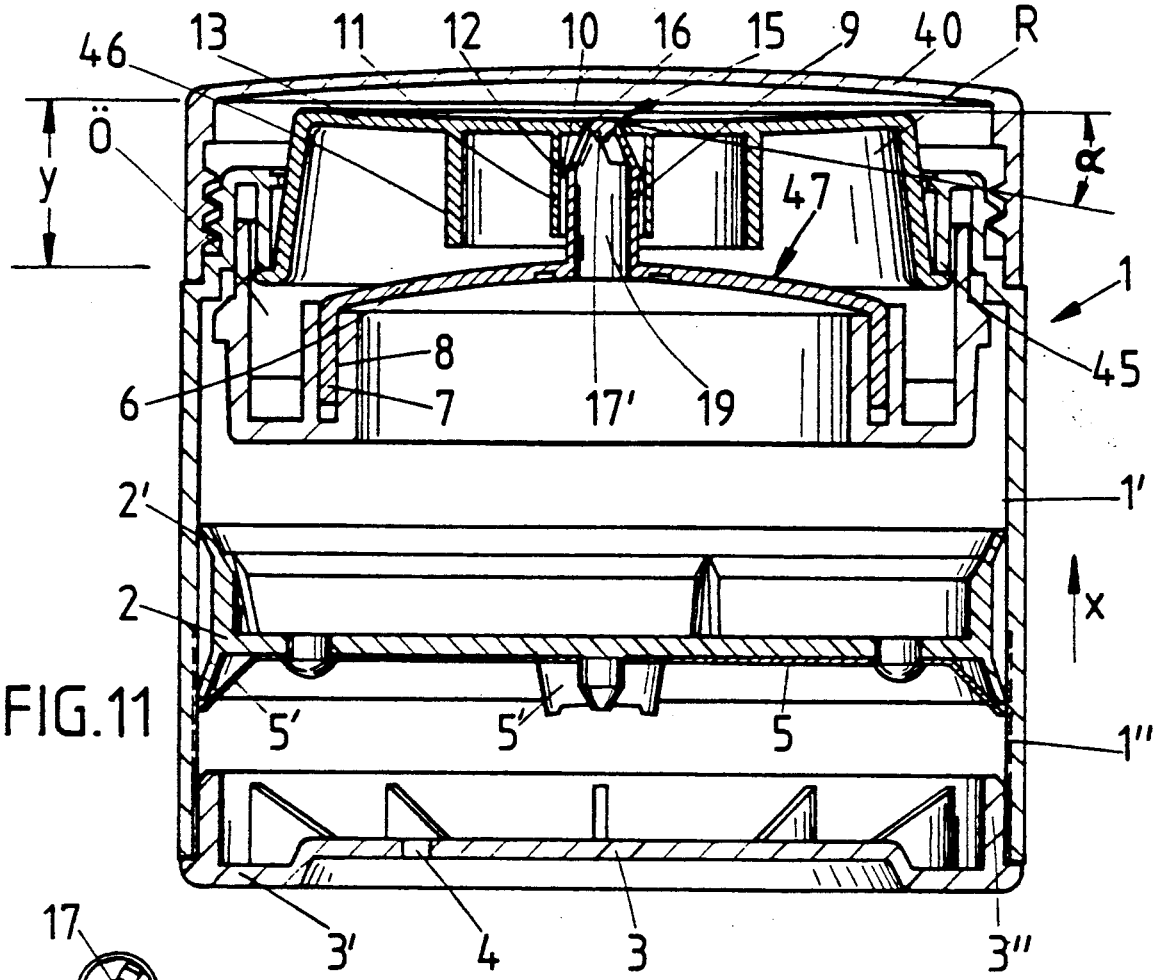
Figure 12:
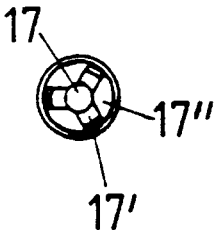

The alternative embodiment shown in FIGS. 11 and 12 has a cover 13 which merely sits on the tube 9 and is protected against removal from the housing 1 by edges 45 of the housing which grip over it. Upon actuation of the cover 13 at its edge as is usually the case upon use, the cover 13 tilts around a point of rotation which is formed approximately by the tube 9. At a distance from the cylinder 11, a push wall 46 is formed which strikes against the pump wall 6 upon the above-described actuation of the cover 13, as indicated at 47. The angle of tilt alpha upon contact with the push wall 46 amounts to about 10°. The push wall 46 is developed as a cylinder, spaced from the cylinder 11 in which the tube 9 is guided. The push wall 46 is located approximately in the region of half the radius with respect to the pump wall 6, which has a circular cross section.

FIG. 12 is a top view of the tube 9 and of the plug 17 formed on the tip thereof. It can be noted that the plug 17 is formed on the tube 9 by means of three small legs 17'. Upon actuation of the cover 13 and, in particular, after the push wall 46 strikes against the pump wall 6, the tube 9, with the attached plug 17, moves downward so that pasty composition can flow around the plug 17 through the free spaces 17'' and emerge through the outlet opening 16.

The dispenser 1 shown corresponds otherwise essentially to the embodiment which was first described, so that, to this extent, reference is made to that description.

Figure 13:
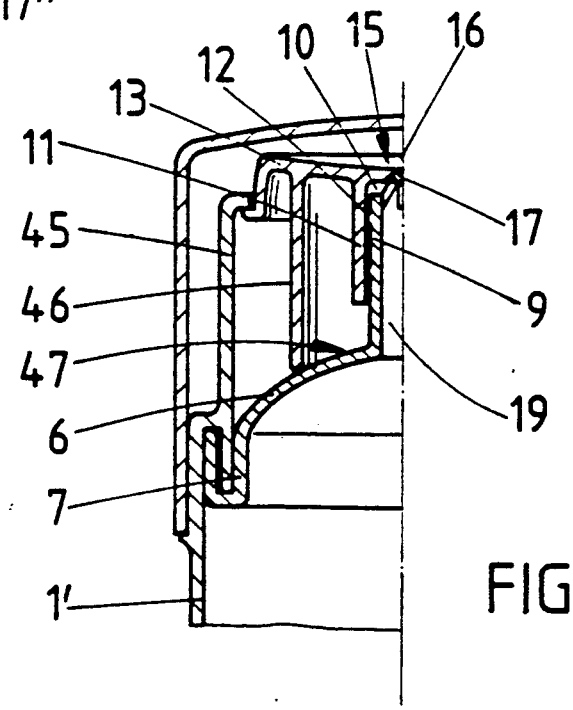

In the embodiment in accordance with FIG. 12, the push wall 46 is seated in unactuated condition directly on the pump wall 6. Upon actuation of the dispenser the push wall 6 is therefore immediately deflected. The embodiment of Fig. 13 corresponds otherwise functionally to the above-described embodiment.

We claim:

1. A dispenser for containing and dispensing a pasty composition comprising a housing adapted to contain the pasty-composition, a restorable pump wall in the housing, a piston disposed in the housing in an emptying direction toward the pump wall, the pasty composition being contained between the pump wall and the piston, the housing having a top cover formed with an outlet opening, the housing having means comprising an external actuating handle for actuating the pump wall such that said wall is pushable in direction of the piston for dispensing the pasty composition from the outlet opening in the top cover of the housing, said pump wall having a tube operatively connecting said cover to the pump wall, said tube being formed with a tube channel, a plug on the tube at an end of the tube channel, and said plug extending into said outlet opening and releasably closing said outlet opening from therebelow.

2. The dispenser according to claim 1, wherein said plug is arranged in a cover-side mouth of the tube channel and is connected to the tube via radial webs, said webs leaving annular slot sections free.

3. The dispenser according to claim 2, wherein said plug has the shape of a double truncated cone, said radial webs extend from a base of said cone.

4. The dispenser according to claim 2, wherein three of said radial webs are arranged at equal angles apart.

5. The dispenser according to claim 1, wherein a longitudinal axis of the plug coincides with a longitudinal center line axis of the dispenser.

6. The dispenser according to claim 1, wherein said actuating handle comprises an edge of said cover, said wall being actable thereupon via lever transmission by means of the cover, a downward protruding push wall is formed on said cover spaced from said tube, a bottom end of the push wall being spaced apart from said pump wall in unactuated condition of said actuating handle, said bottom end of the push wall pushing said pump wall upon actuation of said handle.

7. The dispenser according to claim 6 wherein said push wall cylindrically surrounds said tube.

8. The dispenser according to claim 7, wherein said push wall is located approximately at half the radius of said pump wall.

9. The dispenser according to claim 6, wherein said push wall comes into engagement with said pump wall approximately at an angle of 8°–12°0 of said cover.

10. The dispenser according to claim 1, wherein said actuating handle comprises an edge of said cover, said wall being actable thereupon via lever transmission by means of the cover, a downward protruding push wall is formed on said cover spaced from said tube, a bottom end of the push wall sits on said pump wall in unactuated condition of said actuating handle, and said bottom end of the push wall pushing said pump wall upon actuation of said handle.

11. The dispenser according to claim 1, wherein said actuating handle upon actuation causes and edge of an upper mouth of the tube to move away from the bottom of the cover, said outlet opening of the cover being located laterally spaced from said mouth of the tube, a cylinder being formed by a collar on the bottom of the cover, and an upper end section of the tube being formed as a piston sealingly movably disposed in said cylinder.

12. A dispenser according to claim 11, wherein the bottom of said cover has a projection which enters into said mouth of the tube closing the tube.

13. The dispenser according to claim 1, wherein said actuating handle is formed as a button arranged between said pump wall and said cover, and said actuating handle is displaceable in a movement transversely to a top of the cover, and the movement of displacement of said button, diverted 90°, is converted into a downward movement of the tube and of the pump wall.

14. The dispenser according to claim 13, further comprising an actuating-stroke end stop for said button.

15. The dispenser according to claim 13, wherein said actuating handle further comprises an angle lever mounted fixed in position, said angle lever effecting the diverting of the movement of displacement of said button.

16. The dispenser according to claim 15, wherein said button and said angle lever are formed in one-piece with a film hinge therebetween.

17. The dispenser according to claim 15, wherein said cover forms a bottom of a cup, a cup wall of said cup forming an opening in which said button is disposed, and at least one pivot pin for mounting said angle lever.

18. The dispenser according to claim 17, wherein said cup wall of said cover is clipped on over an annular rib on the housing.

19. The dispenser according to claim 17, wherein said button is arranged in a circular segment-shaped notch on the cup wall.

20. The dispenser according to claim 17, further comprising anti-twisting means between said cup wall and said housing.

21. The dispenser according to claim 17, further comprising an actuating-stroke end stop for said button, two bearing lugs bearing said pivot pin for said button, said lugs face the button, said end stop is on a side of the housing and is formed by end surfaces of said two bearing lugs.

22. The dispenser according to claim 17, wherein an outer surface of said button substantially continues a contour of said cup wall.

23. The dispenser according to claim 15, wherein one arm of the angle lever is disposed in forklike manner around said tube and forms spherical push skids on a bottom of said arm engaging said pump wall adjacent said tube.

* * * * *